US005513999A

United States Patent [19]

Fry et al.

[11] Patent Number: 5,513,999

[45] Date of Patent: May 7, 1996

[54] ELECTRICAL CONNECTOR ASSEMBLY WITH A SWITCH

[75] Inventors: Rupert J. Fry, Des Plaines; Gary E. Polgar, Bolingbrook, both of Ill.

[73] Assignee: Molex Incorporated, Lisle, Ill.

[21] Appl. No.: 252,724

[22] Filed: Jun. 2, 1994

[51] Int. Cl.[6] ..... H01R 13/703

[52] U.S. Cl. ..... 439/188; 200/51.09; 439/378

[58] Field of Search ..... 439/188, 374, 439/378; 200/51.09

[56] References Cited

U.S. PATENT DOCUMENTS

| | | | |
|---|---|---|---|
| 3,066,643 | 12/1962 | Flanagan, Jr. | 439/669 |
| 3,270,267 | 8/1966 | Nolte, Jr. | 439/34 |
| 3,755,635 | 8/1973 | McGill | 200/51.09 |
| 4,389,551 | 6/1983 | Deibele et al. | 200/51 R |
| 4,393,283 | 7/1983 | Masuda | 200/51.09 |
| 4,426,558 | 1/1984 | Tanaka et al. | 200/51.09 |
| 4,481,458 | 11/1984 | Lane | 320/2 |
| 4,528,429 | 7/1985 | Dobson et al. | 200/50 B |
| 4,575,704 | 3/1986 | Pezold | 439/622 |
| 4,726,775 | 2/1988 | Owen | 439/49 |
| 4,927,787 | 5/1990 | Patel | 439/189 |
| 5,023,417 | 6/1991 | Magiera | 200/331 |
| 5,075,518 | 12/1991 | Matsumoto | 200/51.09 |
| 5,095,182 | 3/1992 | Thompson | 200/51.09 |
| 5,186,639 | 2/1993 | Comerci et al. | 439/188 |

*Primary Examiner*—Neil Abrams
*Attorney, Agent, or Firm*—Stephen Z. Weiss

[57] ABSTRACT

A connector assembly is provided for use in conjunction with a switch that includes a switch actuator, such that the switch is automatically actuated in response to the partial mating of the connector assembly. A first connector includes a dielectric housing having terminals mounted therein. The first connector housing has the switch mounted thereon. A second connector includes a dielectric housing having terminals mounted therein adapted for interengagement with the terminals of the first connector. The second connector housing includes an actuating plug for engaging and actuating the switch actuator automatically when the connectors are partially mated.

4 Claims, 4 Drawing Sheets

ELECTRICAL CONNECTOR ASSEMBLY WITH A SWITCH

FIELD OF THE INVENTION

This invention generally relates to the art of electrical connectors and, particularly, to a connector assembly for use with a switch for actuating the switch automatically in response to mating of the connector assembly.

BACKGROUND OF THE INVENTION

It is known to provide electrical connector systems wherein an electrical switch is actuated in conjunction with the mating of a pair of electrical connectors. For instance, it is known to provide detection switches in conjunction with a pair of mating electrical connectors whereby the switch is used to detect the presence of a properly inserted connector, such as a plug connector. In fact, the receptacle may be a normally "dead" receptacle (i.e., it does not receive current) unless the detection switch is actuated. Such systems might be used as a simple safety measure. The detection switch might be used to detect the presence of a ground terminal of a three-pronged plug, for instance. A very simple plug detection electrical receptacle having an integrated switch is shown in U.S. Pat. No. 5,186,639 to Comerci et al, dated Feb. 16, 1993 and assigned to the assignee of the present invention.

Another example of the use of an electrical switch in conjunction with a connector arrangement is shown in U.S. Pat. No. 4,389,551 to Deibele et al, dated Jun. 21, 1983. In this patent, a probe-actuated guard-shield switch mechanism is used to automatically disconnect a guard-shield to an input terminal of a measurement instrument upon insertion of a guard probe into a connector to interengage respective terminals thereof.

Still further, switches are used in jack connectors, such as is shown in U.S. Pat. No. 5,075,518 to Matsumoto, dated Dec. 24, 1991. This patent shows a jack with a switch, in which a plug is inserted into the jack to displace a separator which, in turn, displaces a movable contact of the switch.

All of the above prior art may be effective for their intended purposes. However, they are rather complicated constructions, at least in relation to the expenses involved in their manufacture, because they employ multiple components, such as separate separators, separate actuators or plungers, separate insulating separating devices and the like. The present is directed to providing a very simple connector assembly for use in conjunction with an electrical switch and is a considerable improvement over the prior art of the character described above.

The present invention has a wide range of applications, but there is a need in the prior art to provide a safety mechanism which would prevent a motor from being operated when the battery for the motor, still being electrically coupled to the motor, is being charged. The present invention satisfies that need and also provides such a simple system that conventional or standard switches can be used or switches of a customer's specification.

SUMMARY OF THE INVENTION

An object, therefore, of the invention is to provide a new and improved connector assembly for use in conjunction with a switch, such that the switch is automatically actuated in response to the partial mating of the connector assembly.

In the exemplary embodiment of the invention, the connector assembly is used in conjunction with a switch that includes a housing and a switch actuator. The connector assembly includes a first connector including a dielectric housing having terminals mounted therein. The first connector housing has mounting means for mounting the switch therein. A second connector includes a dielectric housing having terminals adapted for interengagement with the terminals of the first connector. Actuating means are provided on the second housing for engaging and actuating the switch actuator automatically when the connectors are partially mated.

As disclosed herein, the mounting means include means for slidably receiving the switch housing onto the housing of the first connector. Snap-latch means are provided for holding the switch in proper position. The housing further defines a cavity substantially enclosing the switch actuator. The cavity is adapted to receive the actuating means of the second connector upon mating of the connectors.

Still further, the housing of the first connector comprises a one-piece unitarily molded structure, and the housing of the second connector, with the actuating means thereon, also comprises a one-piece unitarily molded structure. The first connector is in the form of a male connector, and the second connector is in the form of a female connector. The terminals of the first and second connectors comprise plug and receptacle type terminals.

Lastly, the mounting means on the first connector is adapted to mount the switch such that the switch actuator is in a given position, and the terminal means are mounted at given relative positions on the respective connector housings, such that the actuating means engages and actuates the switch actuator prior to interengagement of the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
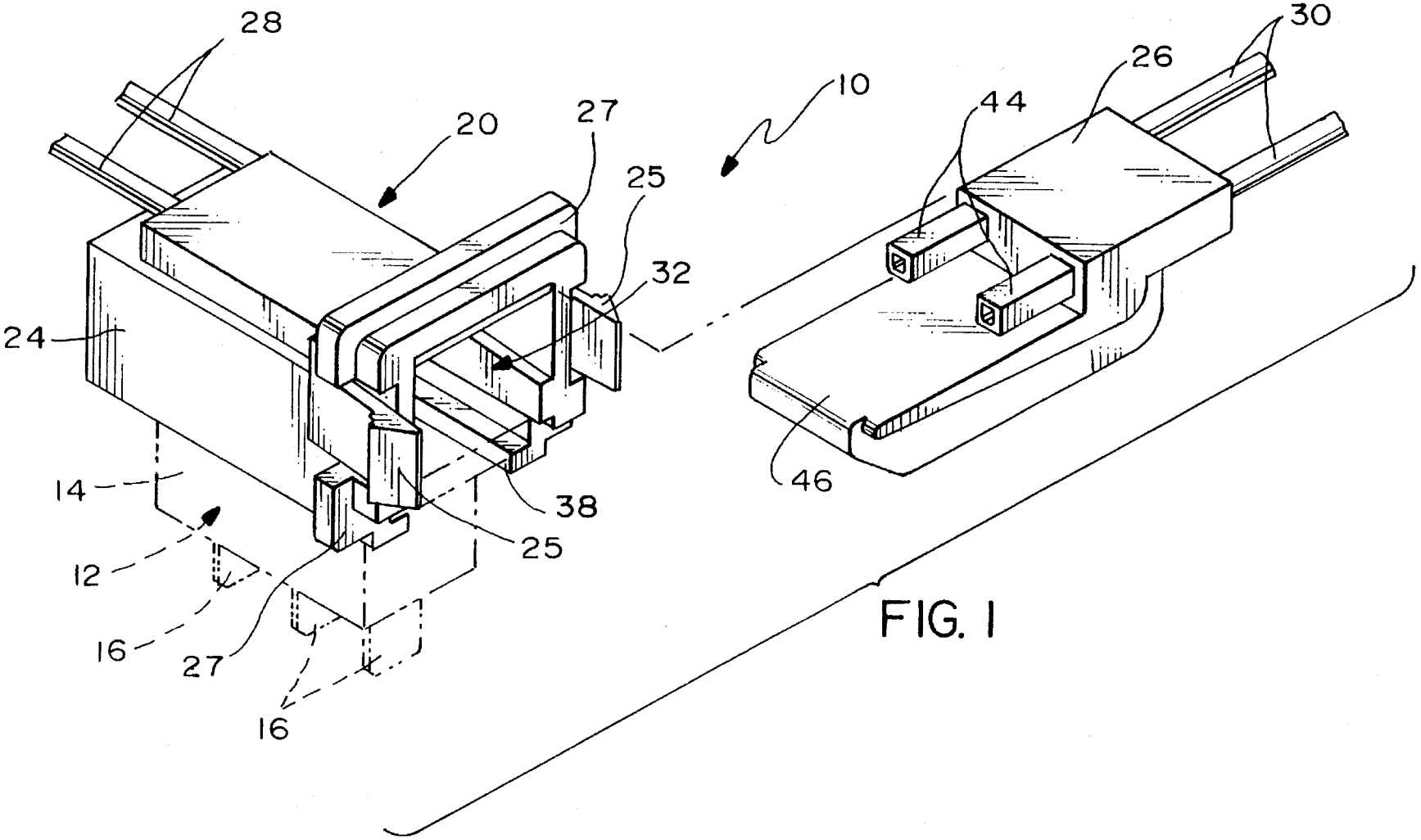
FIG. 1 is an exploded perspective view of the connector assembly of the present invention, in conjunction with a switch that is shown in phantom.
Figure 2:
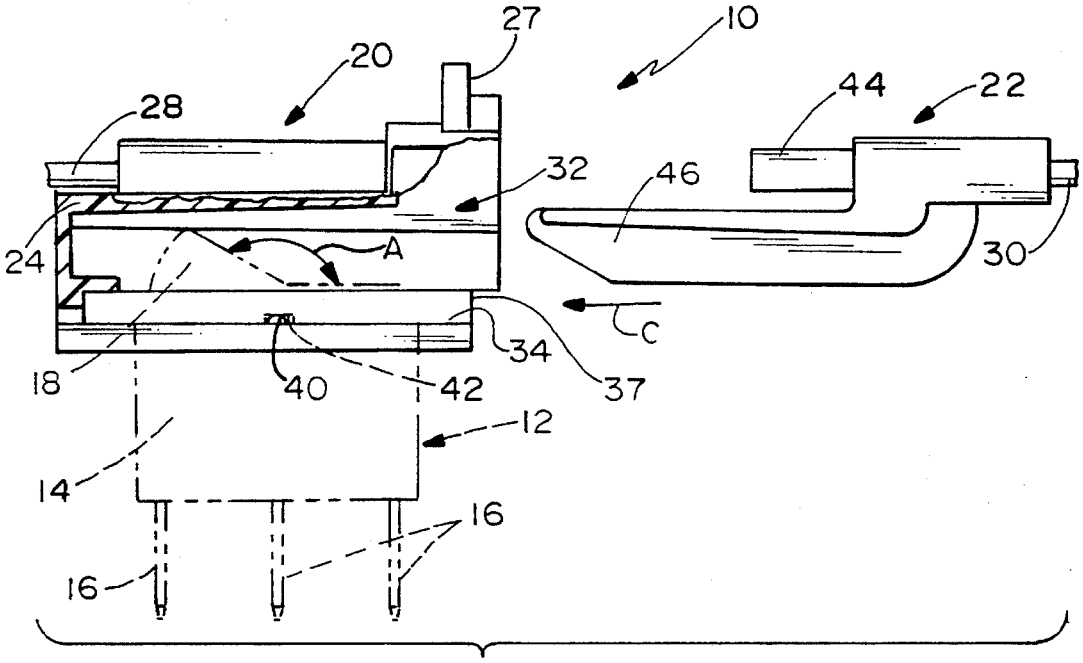
FIG. 2 is a side elevational view of the connector assembly, with the female connector in partial section, and the switch again being shown in phantom.

Referring to the drawings in greater detail, and first to FIGS. 1 and 2, the invention is incorporated in a connector assembly, generally designated 10, for use in conjunction with a switch, generally designated 12 and shown in phantom. The switch includes a housing 14 with terminals 16 projecting from the bottom thereof, and with a rocker-arm type switch actuator 18 (FIG. 2) pivotally mounted on the switch for movement in the direction of double-headed arrow "A".

Generally, connector assembly 10 includes a first or female connector, generally designated 20, and a second or male connector, generally designated 22. Female connector 20 has a one-piece unitarily molded housing 24, and male connector 22 has a one-piece unitarily molded housing 26. The housings are molded of dielectric material, such as plastic or the like. Female connector 20 terminates a pair of electrical wires or cables 28, and male connector 22 terminates a pair of electrical wires or cables 30. The respective electrical wires or cables are terminated to terminal means within the respective connectors, as will be described in greater detail hereinafter. Housing 24 of female connector 20 defines a cavity, indicated generally at 32 for receiving the male connector. It can be understood from the above general description that connector assembly 10 is designed for automatically actuating switch 12 in response to mating of female and male connectors 20 and 22, respectively. The female connector housing 24 is mounted in an aperture 21 in a panel 23 shown in FIG. 3. The forwardly extending flexible locking arms 25 flex inwardly as the female connector housing 24 is inserted into the panel aperture 21. When fully inserted into the aperture 21, the locating flange 27 of housing 24 will hold the housing 24 by preventing it from continuing through the aperture 21 and the locking arms 25 will snap behind the opposite panel surface preventing the female connector housing 24 from backing out of the aperture.

Figure 3:
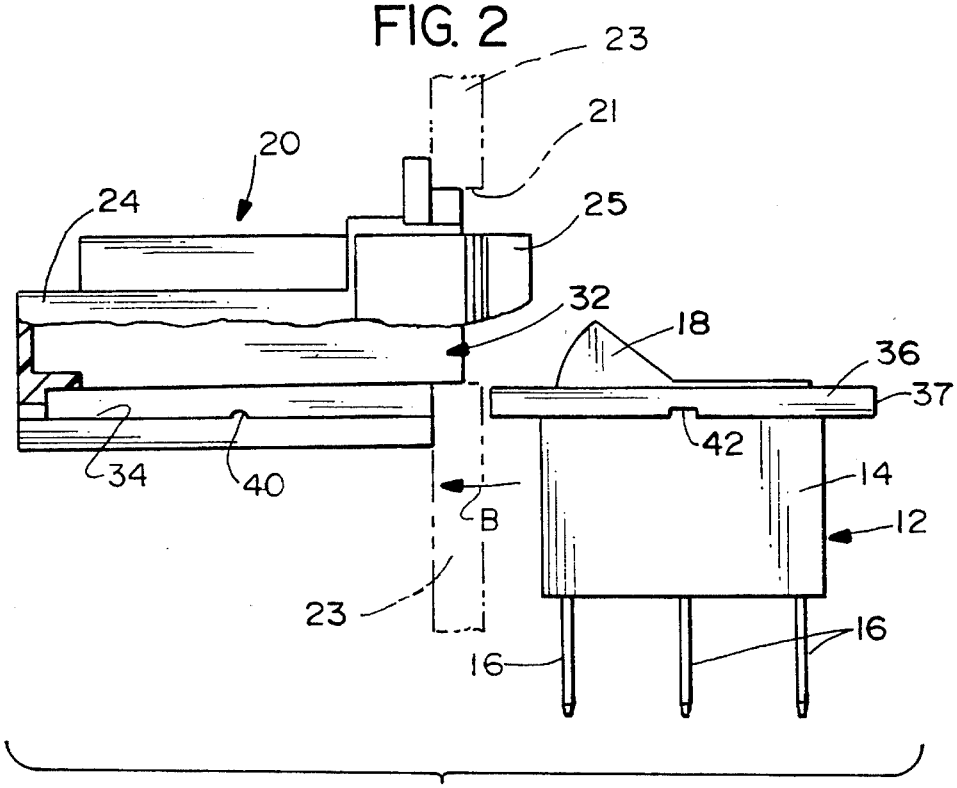
FIG. 3 is a side elevational view of the female connector, partially in section, with the switch shown removed therefrom.

More particularly, referring to FIG. 3 in conjunction with FIGS. 1 and 2, generally, mounting means are provided on housing 24 of female connector 22 for slidably receiving switch 12 in the direction of arrow "B" (FIG. 3) such that switch actuator 18 is properly located within cavity 32 of the connector housing. More particularly, opposite side walls of housing 24 are provided with interior grooves 34 which form sliding rails for receiving outwardly projecting flanges 36 at opposite sides of the switch housing. In assembly, the switch is assembled to female connector 22 by positioning flanges 36 of the switch housing into grooves 34 of the connector housing. The bottom of the connector housing is open, as can be seen best at 38 in FIG. 1, whereby the switch projects out of the bottom of the connector housing, while switch actuator 18 projects upwardly into interior cavity 32 of the connector housing.

Generally, means are provided to define the proper assembled position of switch 12 within female connector 22. More particularly, again referring to FIG. 3 in conjunction with FIG. 2, a detent tab 40 projects upwardly within each groove 34, and a downwardly facing detent notch 42 (FIG. 3) is formed in the bottom of each flange 36. When the switch is assembled to the connector, the detect tabs and detent notches form a snap-latch means for holding the switch in proper position within the connector housing. During assembly, this snap-latch action can be "felt" by a person assembling the switch into the connector. The trailing end 37 of flange 36 also helps to hold the switch in proper position since when the female connector housing 24 is mounted to the panel 23, the trailing end 37 will abut one surface of panel 23.

Male connector 22 include a pair of plug portions 44 which house the terminals of the connector, as will be described hereinafter. The plugs project forwardly of housing 26 as seen in FIGS. 1 and 2. The male connector also includes an actuating means in the form of a sizable actuating plug 46 molded integrally with and projecting forwardly of housing 26. As seen in FIG. 2, but as described in greater detail below, when male connector 22 is inserted into female connector 20 in the direction of arrow "C", actuating plug 46 enters cavity 32 and is effective for engaging and actuating switch actuator 18. In other words, the switch is actuated automatically in response to mating of connectors 20 and 22 of connector assembly 10.

Figure 4:
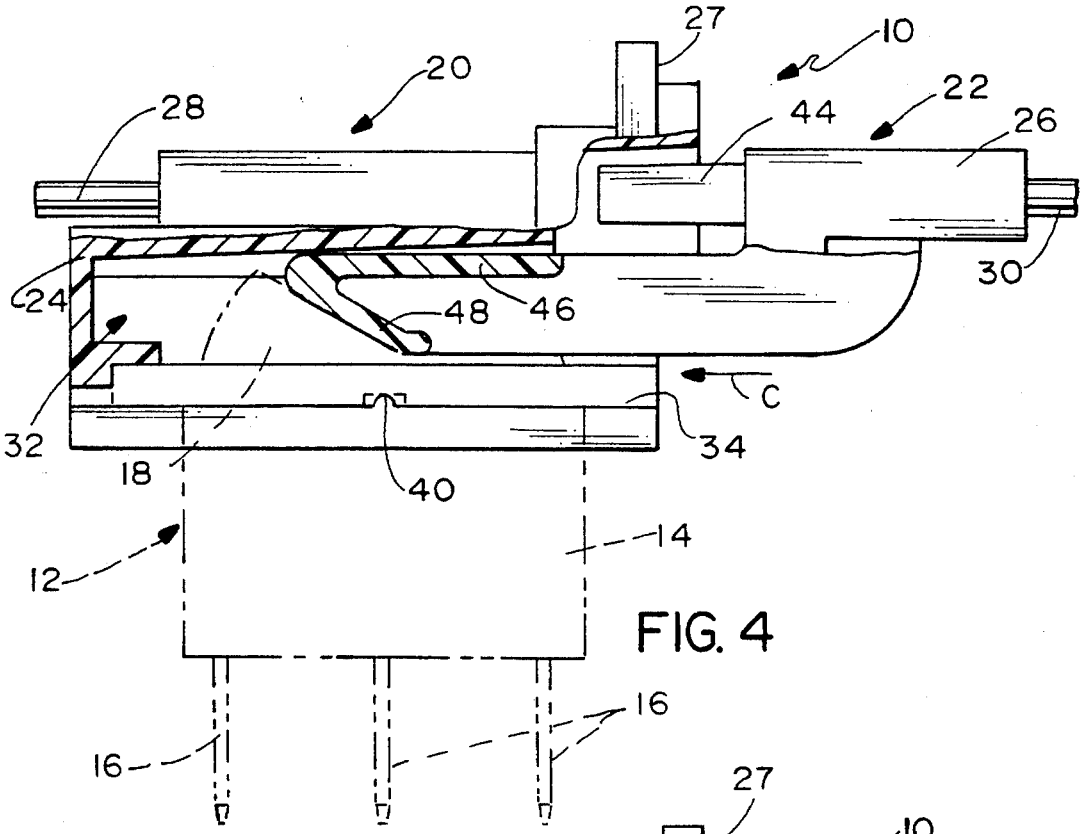
FIGS. 4–7 are views similar to that of FIG. 2, but showing the two connectors in sequential positions during mating.

Referring to FIGS. 4–7, these depictions show sequential views of mating of connector assembly 10. It can be seen that actuating plug 46 of male connector 22 actually has a downwardly and rearwardly inclined actuating lip 48 that engages switch actuator 18. As best seen in FIG. 4, the actuating lip is inclined at an angle matching the angle of the top surface of the switch actuator when the actuator is in its initial position. In the relative positions of connectors 20 and 22 and switch 12 in FIG. 4, it can be seen that the connectors are only partially mated; switch actuator 18 has not been moved to any extent; and terminal plugs 44 of male connector 22 have yet to be inserted into any operative portion of female connector 20. In other words, male connector 22 has been inserted from the position shown in FIG. 2, in the direction of arrow "C", to the partially inserted position of FIG. 4.

Figure 5:
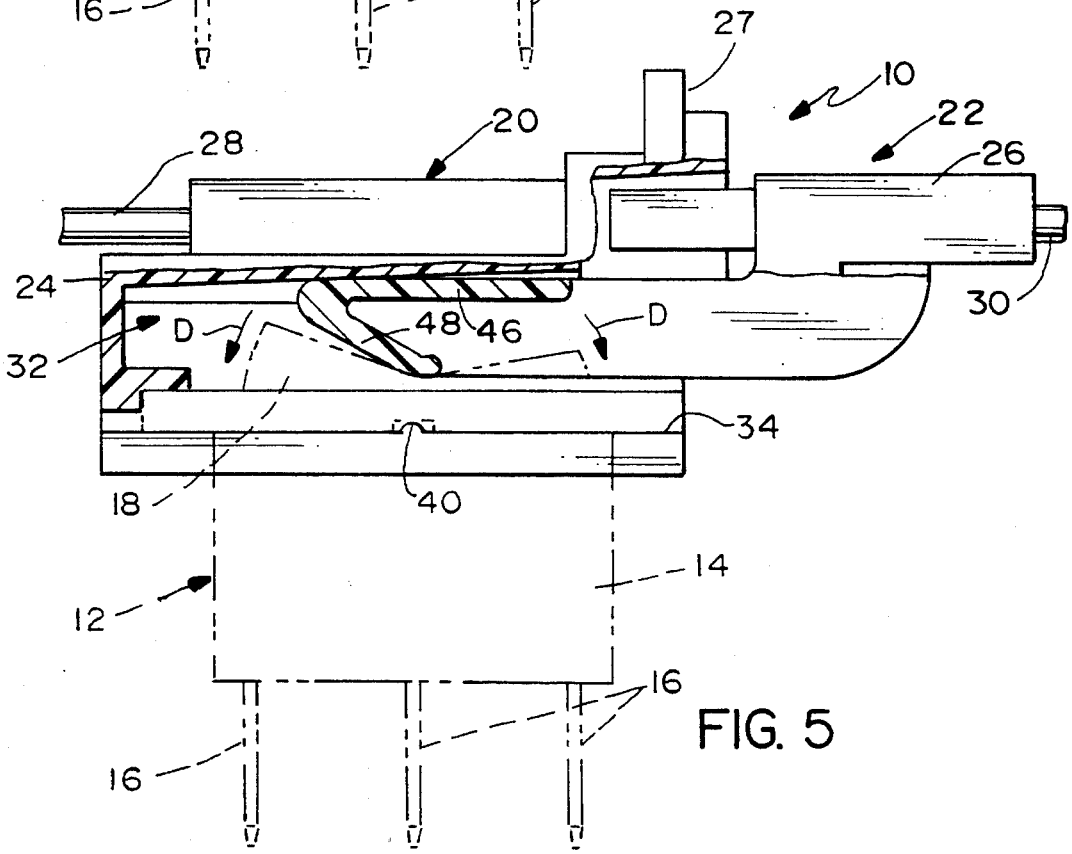

FIG. 5 shows male connector 22, particularly actuating plug 46 and actuating lip 48, inserted further into cavity 32 to an extent that switch actuator 18 has begun to be pivotally moved in the direction of arrows "D".

Figure 6:
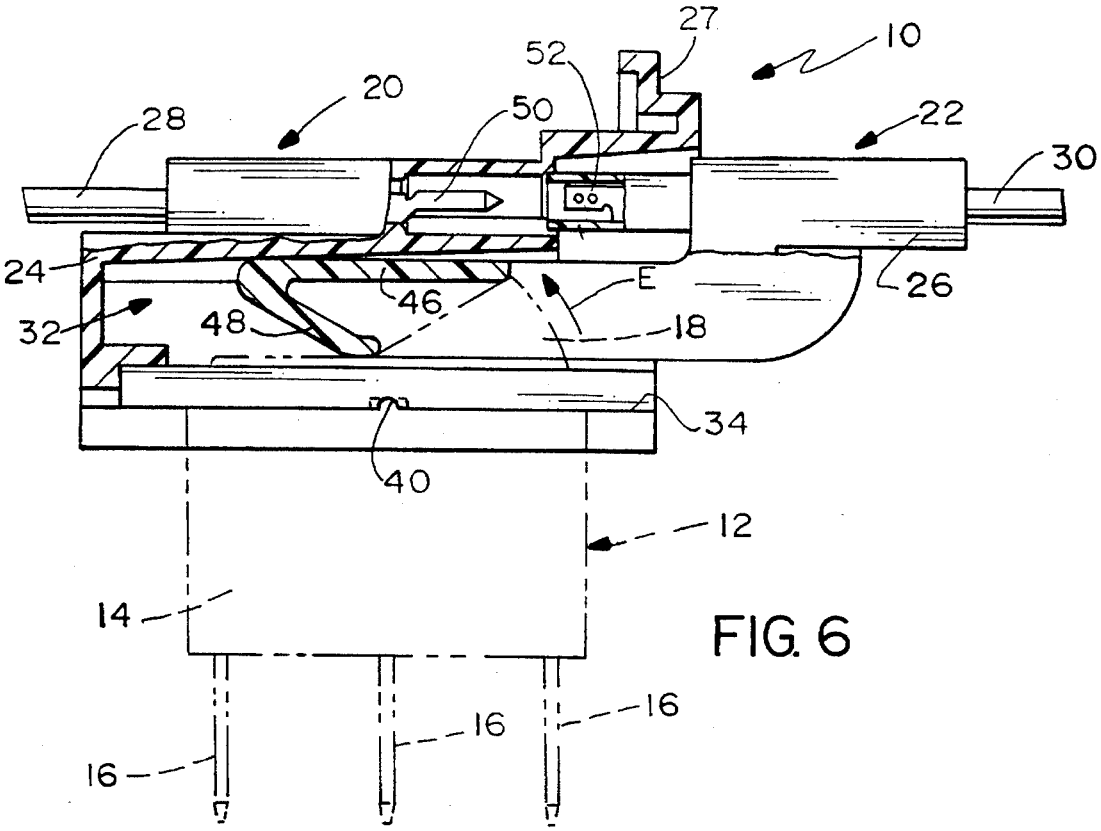

FIG. 6 shows the relative positions of connectors 20 and 22 wherein actuating plug 46, and particularly actuating lip 48, has pivoted switch actuator 18 in the direction of arrow "E" to its fully actuated position. In other words, the mode of switch 12 now has been changed completely by the mating of the connectors to the extent shown in FIG. 6.

Figure 7:
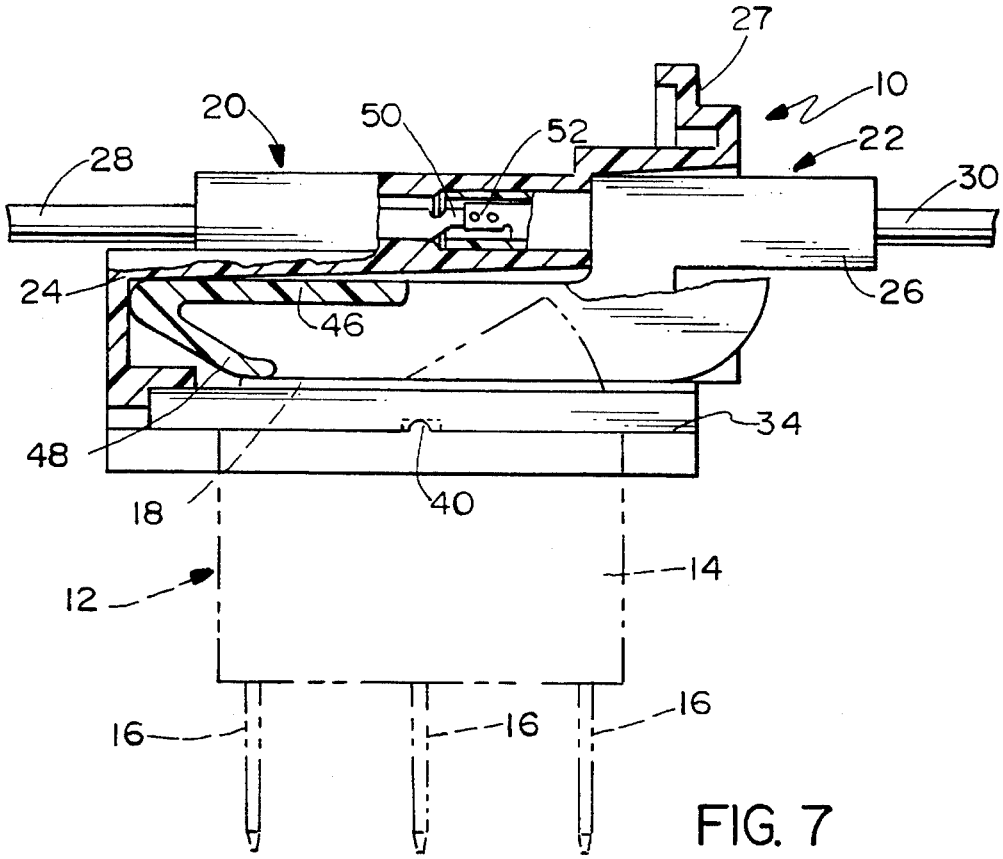

Before proceeding to the final depiction in FIG. 7, it should be understood that the preferred embodiment of the invention is designed such that switch 12 is mounted at a given position within female connector 20 whereby the switch will be actuated before the respective terminal means of the connectors are interengaged. More particularly, referring to FIG. 6, it can be seen that plug-type terminals 50 are terminated to electrical wires or cables 28 within female connector 20, and receptacle terminals 52 are terminated to wires or cables 30 within male connector 22. However, it should be noted that, in the relative positions of the connectors in FIG. 6, the respective terminals have not been interengaged, notwithstanding the fact that switch 12 has been fully actuated as described above.

Now, referring to FIG. 7, it can be seen that plug and receptacle terminals 50 and 52, respectively, of female and male connectors 20 and 22, respectively, have been fully interengaged, while actuating lip 48 of actuating plug 46 still engages and maintains switch actuator 18 in its switched position.

As stated in the "Background", above, connector assembly 10 and switch 12 can be used in an exemplary application to prevent a motor from being operated when a battery for the motor, still electrically coupled to the motor, is being charged. Therefore, it would be desirable to completely disable the motor before the charger is electrically energized. With the "actuating-before-terminating" system described above, switch 12 can be electrically coupled to the motor, with actuation of the switch disabling the motor, prior to energizing the charger by interengaging terminals 50 and 52.

Lastly, upon unmating of male connector 22 from female connector 20, actuating lip 48 again will engage the rocker-arm type switch actuator 18 as in the position of FIG. 6 (but moving in the direction opposite the insertion direction "C") and turn the switch back to its original mode after the unmating of the connectors. The rocker-arm type switch actuator often is spring-loaded to hold the switch actuator in its initial position of FIG. 4 until being actuated by engagement of lip 48 therewith.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector assembly for use in conjunction with a switch that includes a switch housing and a switch actuator, such that the switch is automatically actuated in response to mating of the connector assembly, comprising:

a first connector including a one piece unitarily molded dielectric housing having terminals mounted therein, the first connector housing having mounting means for mounting the switch thereon, the mounting means including means for slidably receiving the switch housing onto the first connector housing and snap-latch means for holding the switch in proper position on the first connector housing;

a second connector including a one piece unitarily molded dielectric housing having terminals mounted therein and adapted for interengagement with the terminals of the first connector, and actuating means on the second connector housing for engaging and actuating the switch actuator automatically when the first and second connectors are partially mated;

the first connector housing including a cavity substantially enclosing the switch actuator, the cavity being adapted to receive the actuator means of the second connector upon partial mating of the first and second connectors;

the switch actuator having first and second contact surfaces joined together at a pivot point on the actuator and arranged so that when the actuating means contacts the first contact surface, the actuator pivots in a first direction activating the switch, and when the actuating means contacts the second contact surface, the actuator pivots is a second direction opposite the first direction deactivating the switch; and the mounting means being adapted to mount the switch such that the switch actuator is in a given position, and the terminals are mounted at given relative positions on the respective connector housings, such that during mating of the first and second connectors the actuating means slides over the second contact surface and engages the first contact surface activating the switch prior to interengagement of the terminals.

2. The connector assembly of claim 1 wherein said first and second connectors comprise male and female type connectors.

3. The connector assembly of claim 1 wherein the terminal means of the first and second connectors comprise plug and receptacle type terminals.

4. The connector assembly of claim 1 wherein, the actuating means of the second connector is adapted to slide over and remain in contact with the first switch contact surface until the terminals are disengaged during unmating of the first and second connectors, and further adapted to contact the second switch contact surface, after the terminals are disengaged, pivoting the actuator deactivating the switch.

* * * * *